US009743188B2

(12) United States Patent
Zhao et al.

(10) Patent No.: US 9,743,188 B2
(45) Date of Patent: Aug. 22, 2017

(54) AUDIO PLUG TYPE DETECTION

(71) Applicant: Texas Instruments Incorporated, Dallas, TX (US)

(72) Inventors: Xiaochun Zhao, Allen, TX (US); Jim Kien Huy Le, Fort Collins, CO (US)

(73) Assignee: Texas Instruments Incorporated, Dallas, TX (US)

( * ) Notice: Subject to any disclaimer, the term of this patent is extended or adjusted under 35 U.S.C. 154(b) by 23 days.

(21) Appl. No.: 14/925,416

(22) Filed: Oct. 28, 2015

(65) Prior Publication Data

US 2016/0269842 A1 Sep. 15, 2016

Related U.S. Application Data

(60) Provisional application No. 62/131,420, filed on Mar. 11, 2015.

(51) Int. Cl.

| | |
|---|---|
| ***H04R 29/00*** | (2006.01) |
| ***H04R 5/04*** | (2006.01) |
| *H01R 24/58* | (2011.01) |
| *H01R 107/00* | (2006.01) |

(52) U.S. Cl.

CPC ..... *H04R 5/04* (2013.01); *H01R 24/58* (2013.01); *H01R 2107/00* (2013.01); *H04R 2420/09* (2013.01)

(58) Field of Classification Search

CPC ..... H04R 2420/05; H04R 2420/09; H04R 1/1041; H04R 5/04; H04R 1/1033; H04R 2201/107; H04R 3/00; H04R 2499/11; H04R 29/00; H04R 1/1016; H04R 1/1083; H04R 1/1091; H04R 29/004; H04R 1/06; H04R 1/083; H04R 1/10; H04R 2420/03; H04R 1/02; H04R 2420/01

USPC ..... 381/58, 74, 309, 384, 394, 94.5, 110, 381/122, 123, 26, 300, 311, 369, 379, 381/71.6, 81

See application file for complete search history.

(56) References Cited

U.S. PATENT DOCUMENTS

| | | | | |
|---|---|---|---|---|
| 2011/0085673 | A1* | 4/2011 | Lee | H01R 24/58 381/74 |
| 2012/0019309 | A1* | 1/2012 | Turner | H03K 5/1254 327/524 |
| 2012/0237051 | A1* | 9/2012 | Lee | H01R 13/66 381/74 |
| 2013/0021046 | A1* | 1/2013 | Prentice | H04R 29/004 324/705 |

(Continued)

*Primary Examiner* — Akelaw Teshale
(74) *Attorney, Agent, or Firm* — Lawrence J. Bassuk; Charles A. Brill; Frank D. Cimino

(57) ABSTRACT

Systems and methods for audio plug type detection excursion are described. In some embodiments, a method may include: receiving an audio plug at an audio jack; grounding a sleeve terminal of the audio jack; applying an electrical current to a second ring terminal of the audio jack; and measuring a voltage between the second ring terminal and the sleeve terminal. In other embodiments an electronic circuit may include a controller and a memory coupled to the controller, the memory having program instructions stored thereon that, upon execution by the controller, cause the controller to: ground a sleeve terminal of an audio jack; apply an electrical current to a second ring terminal of the audio jack; and measure a voltage between the second ring terminal and the sleeve terminal.

7 Claims, 6 Drawing Sheets

(56) References Cited

U.S. PATENT DOCUMENTS

| | | | | |
|---|---|---|---|---|
| 2014/0017955 | A1* | 1/2014 | Lo | H01R 13/703<br>439/668 |
| 2014/0038460 | A1* | 2/2014 | Lee | H04R 29/004<br>439/620.01 |

* cited by examiner

AUDIO PLUG TYPE DETECTION

CROSS-REFERENCE TO RELATED APPLICATIONS

This application claims priority to U.S. Provisional Patent Application Ser. No. 62/131,420 titled "A ROBUST, LOW NOISE CURRENT-BASED APPROACH FOR TRS AND TRRS AUDIO PLUG TYPE DETECTION" and filed on Mar. 11, 2015, which is incorporated by reference herein.

TECHNICAL FIELD

This specification is directed, in general, to electronics, and, more specifically, to systems and methods for audio plug type detection.

BACKGROUND

In recent years, consumer electronic devices such as cell phones, portable media players, tablets, laptops, desktops, televisions, navigation systems, etc. have become ubiquitous. These devices often include an audio jack through which they receive and/or provide audio signals. Generally speaking, an audio jack is configured to receive an audio plug that is connected through electrical wires or cables to a stereo, receiver, speakers, headphones, etc.

Audio plugs can have any number of ring-shaped contacts, terminals, or poles along their lengths. A common type of audio plug is the TRS type, with "Tip," "Ring," and "Sleeve" terminals, in that order. Traditional TRS-type plugs carry the left channel (tip), right channel (ring), and ground (sleeve).

Another common type of audio plug is the TRRS type, with "Tip," "first Ring," "second Ring," and "Sleeve" terminals, which may have different configurations: standard or Open Mobile Terminal Platform (OMTP). Contacts for a standard plug include the left channel (tip), right channel (first ring), ground (second ring), and microphone (sleeve). In an OMTP plug, the tip and first ring terminals also carry the left and right channels, respectively, but the second ring is a microphone contact and the sleeve terminal has the ground contact—i.e., the last two terminals are reversed relative to the standard plug.

Because a user may connect any type of audio plug to the same jack, detection circuitry has been developed to determine which type of audio plug is inserted.

Conventional plug detection is achieved by grounding the tip terminal, injecting a small electrical current first onto the second ring terminal (first detection), and then onto the sleeve terminal (second detection). A three-bit Analog-to-Digital (ADC) circuit measures the voltage on the second ring and sleeve terminals to convert the detected impedance to a digital value. If the impedance of the second ring is equal to the impedance of the sleeve terminal, the plug type is determined to be a 3-pole plug. Otherwise, if the impedance of the second ring is smaller than the sleeve impedance, the plug type is determined to be a 4-pole standard plug, and if the impedance of the second ring is greater than the sleeve impedance, the plug type is a 4-pole OMTP plug.

The inventors hereof have identified a number of problems with the aforementioned technique. For example, the dynamic range of the ADC needs to be wide enough to account for worst case headset resistance and worst case microphone resistance. Also, the Least-Significant-Bit (LSB) size needs to be small enough to account for minimum microphone resistance. For example, a 3-pole headset may be incorrectly detected as 4-pole if headset's resistance falls right at bin boundary of the ADC.

SUMMARY

Systems and methods for audio plug type detection are described. In an illustrative, non-limiting embodiment, a method may include receiving an audio plug at an audio jack; grounding a sleeve terminal of the audio jack; applying an electrical current to a second ring terminal of the audio jack; and measuring a voltage between the second ring terminal and the sleeve terminal. In many situations, the audio jack is of an unknown type. For example, the electrical current may be of the order of 1 μA.

The method may also include, in response to the magnitude of the voltage being approximately zero, determining that the audio plug is a 3-pole type. Additionally or alternatively, the method may include, in response to a magnitude of the voltage being greater than zero, determining that the audio plug is a 4-pole type. For example, the voltage may be of the order of 500 mV.

The method may further comprise grounding a tip terminal of the audio plug; applying another electrical current to the sleeve terminal and to the second ring terminal of the audio plug; measuring a first voltage between the sleeve terminal and the tip terminal; and measuring a second voltage between the second ring terminal and the tip terminal.

In some cases, applying the other electrical current may include concurrently applying the other current to the sleeve terminal and to the second ring terminal. The other electrical current may be of the order of 1 μA, and a difference between the first and second voltages may be of the order of 200 mV.

In response to a magnitude of the first voltage being greater than a magnitude of the second voltage, the method may include determining that the audio plug is a standard 4-pole audio plug. In response to a magnitude of the first voltage being smaller than a magnitude of the second voltage, the method may include determining that the audio plug is an Open Mobile Terminal Platform (OMTP) 4-pole audio plug.

In another illustrative, non-limiting embodiment an electronic circuit may include a controller; and a memory coupled to the controller, the memory having program instructions stored thereon that, upon execution by the controller, cause the controller to: ground a sleeve terminal of an audio jack; apply an electrical current to a second ring terminal of the audio jack; and measure a voltage between the second ring terminal and the sleeve terminal.

The program instructions, upon execution, may further cause the controller to, in response to the magnitude of the voltage being approximately zero, determine that the audio plug is a 3-pole type. Additionally or alternatively, the program instructions, upon execution, may further cause the controller to, in response to a magnitude of the voltage being greater than zero, determine that the audio plug is a 4-pole type. Additionally or alternatively, the program instructions, upon execution, may further cause the controller to ground a tip terminal of the audio plug; concurrently apply another electrical current to the sleeve terminal and to the second ring terminal of the audio plug; measure a first voltage between the sleeve terminal and the tip terminal; and measure a second voltage between the second ring terminal and the tip terminal.

The program instructions, upon execution, may further cause the controller to, in response to a magnitude of the first voltage being greater than a magnitude of the second voltage, determine that the audio plug is a standard 4-pole audio plug. Additionally or alternatively, the program instructions, upon execution, may further cause the controller to, in response to a magnitude of the first voltage being smaller than a magnitude of the second voltage, determine that the audio plug is an OMTP 4-pole audio plug.

In yet another illustrative, non-limiting embodiment, an audio device may include an audio jack configured to receive an audio plug of an unknown type; and an electronic circuit coupled to the audio jack, the electronic circuit configured to: ground a sleeve terminal of the audio jack; apply an electrical current to a second ring terminal of the audio jack; measure a voltage between the second ring terminal and the sleeve terminal; and at least one of: in response to the magnitude of the voltage being approximately zero, determine that the audio plug is a 3-pole type, or in response to a magnitude of the voltage being greater than zero, determine that the audio plug is a 4-pole type.

The electronic circuit may be further configured to: ground a tip terminal of the audio plug; concurrently apply another electrical current to the sleeve terminal and to the second ring terminal of the audio plug; measure a first voltage between the sleeve terminal and the tip terminal; measure a second voltage between the second ring terminal and the tip terminal; and at least one of: in response to a magnitude of the first voltage being greater than a magnitude of the second voltage, determine that the audio plug is a standard 4-pole audio plug, or in response to a magnitude of the first voltage being smaller than a magnitude of the second voltage, determine that the audio plug is an OMTP 4-pole audio plug.

BRIEF DESCRIPTION OF THE DRAWINGS

Figure 1:
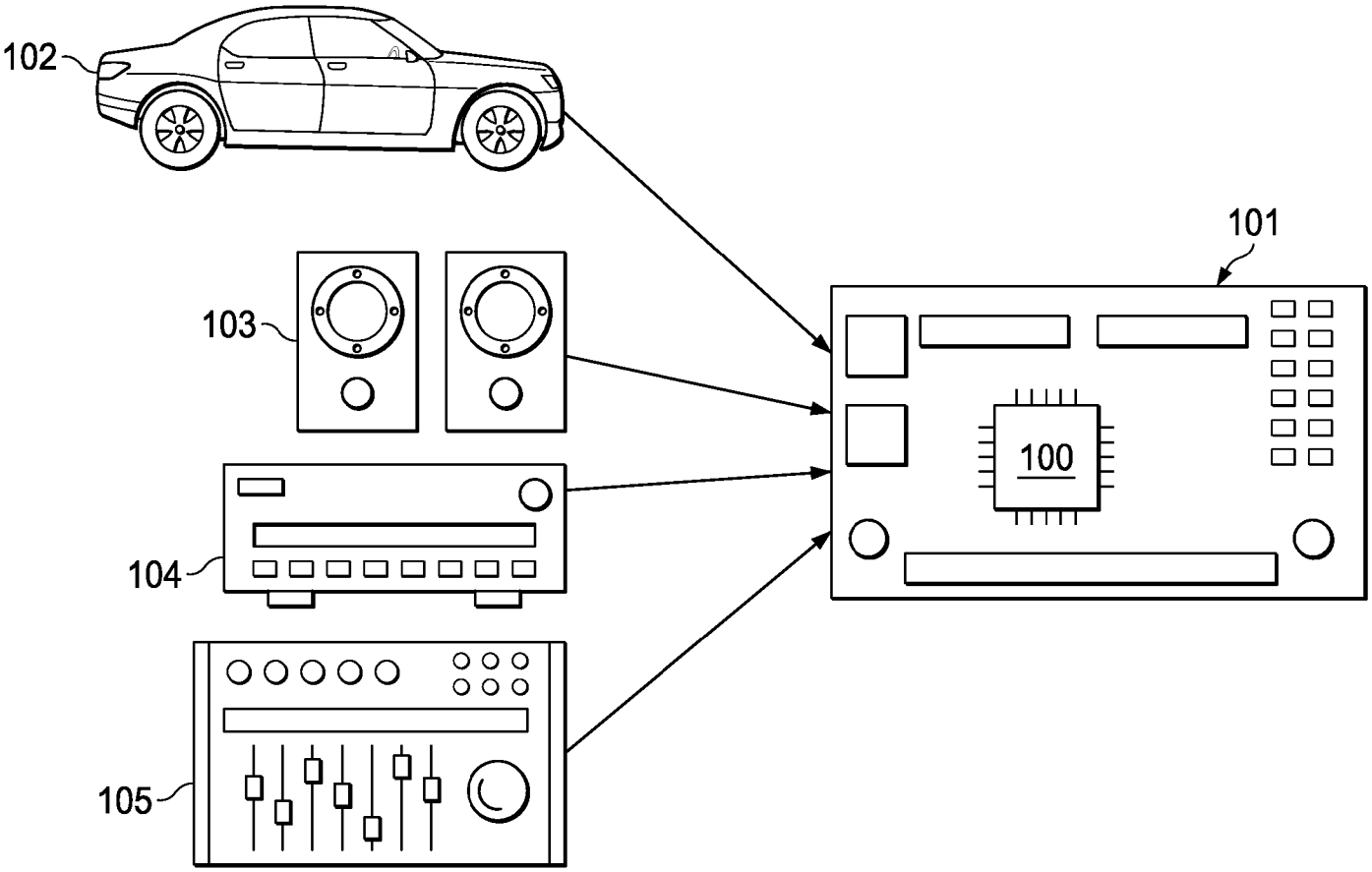

Having thus described the invention(s) in general terms, reference will now be made to the accompanying drawings, wherein:

FIG. 1 is a diagram of an example of an audio system according to some embodiments.

Figure 2:
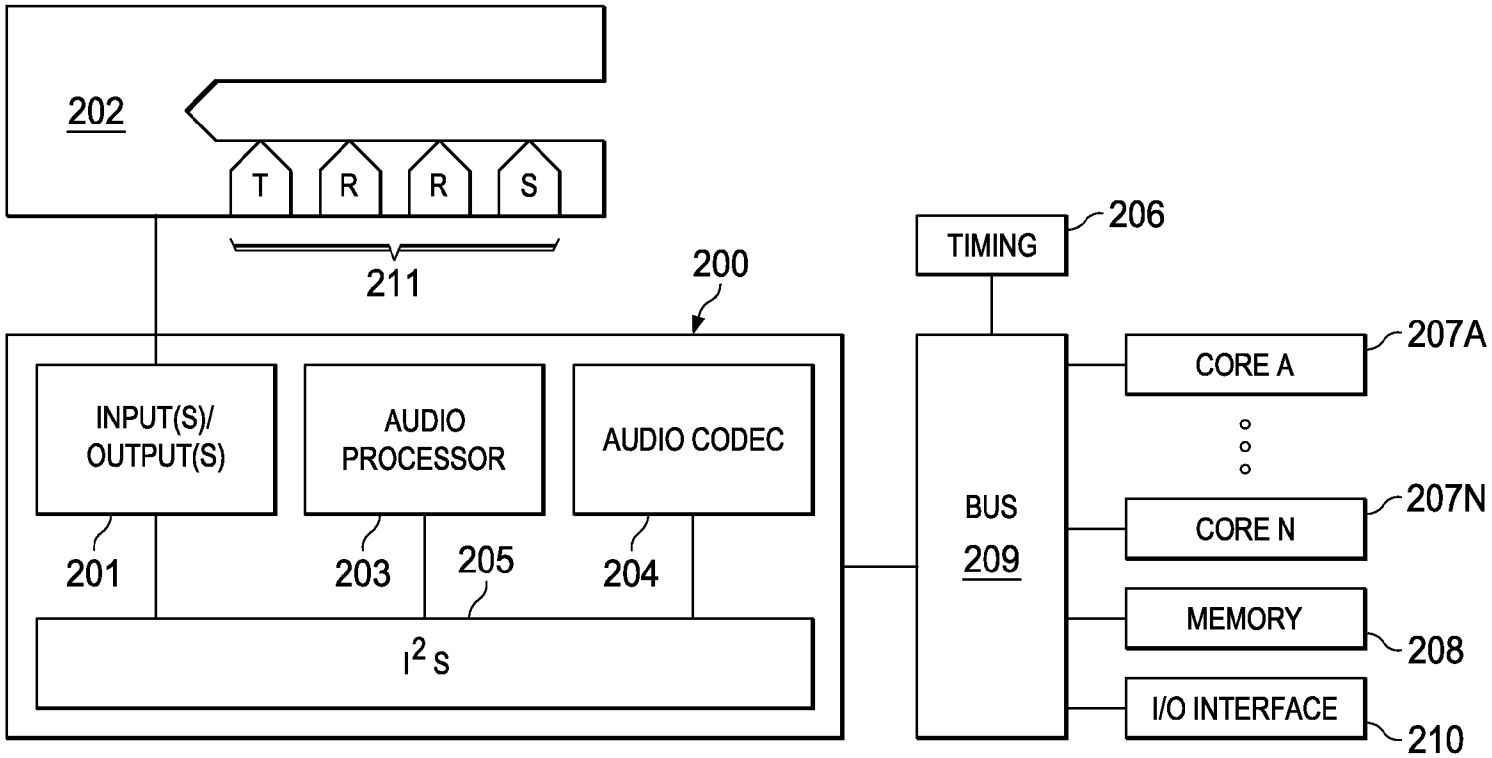

FIG. 2 is a block diagram of an examples of an for audio plug type detection circuit according to some embodiments.

Figure 3:
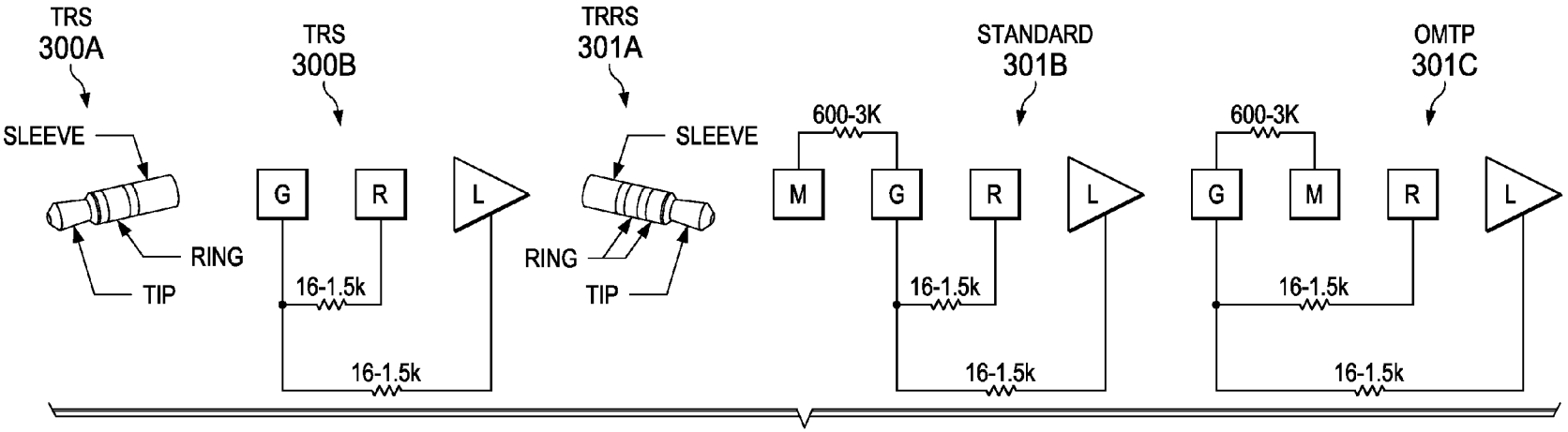

FIG. 3 are diagrams of examples of various audio plug types detectable according to some embodiments.

Figure 4:
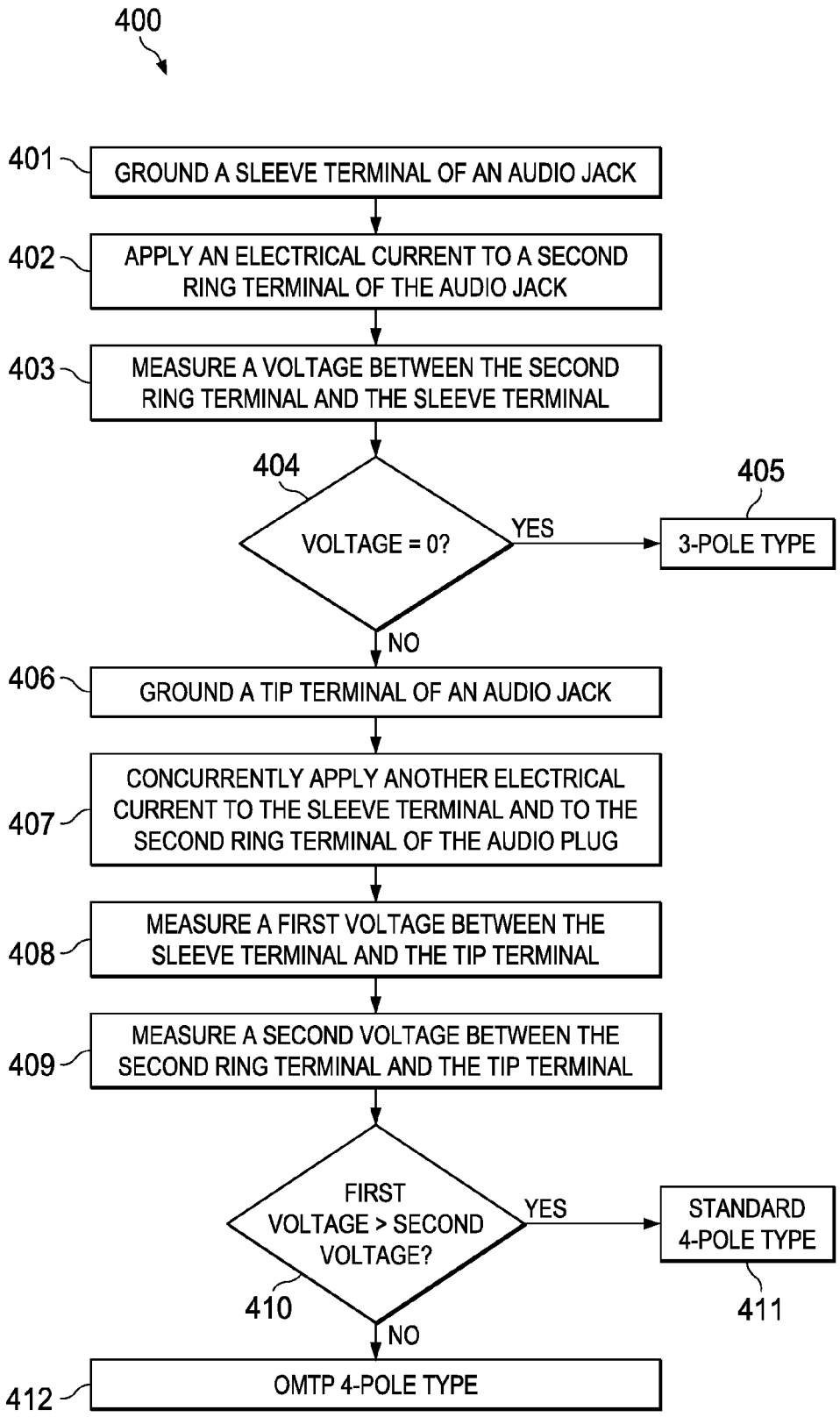

FIG. 4 is a flowchart of an example of a method for audio plug type detection according to some embodiments.

Figure 5:
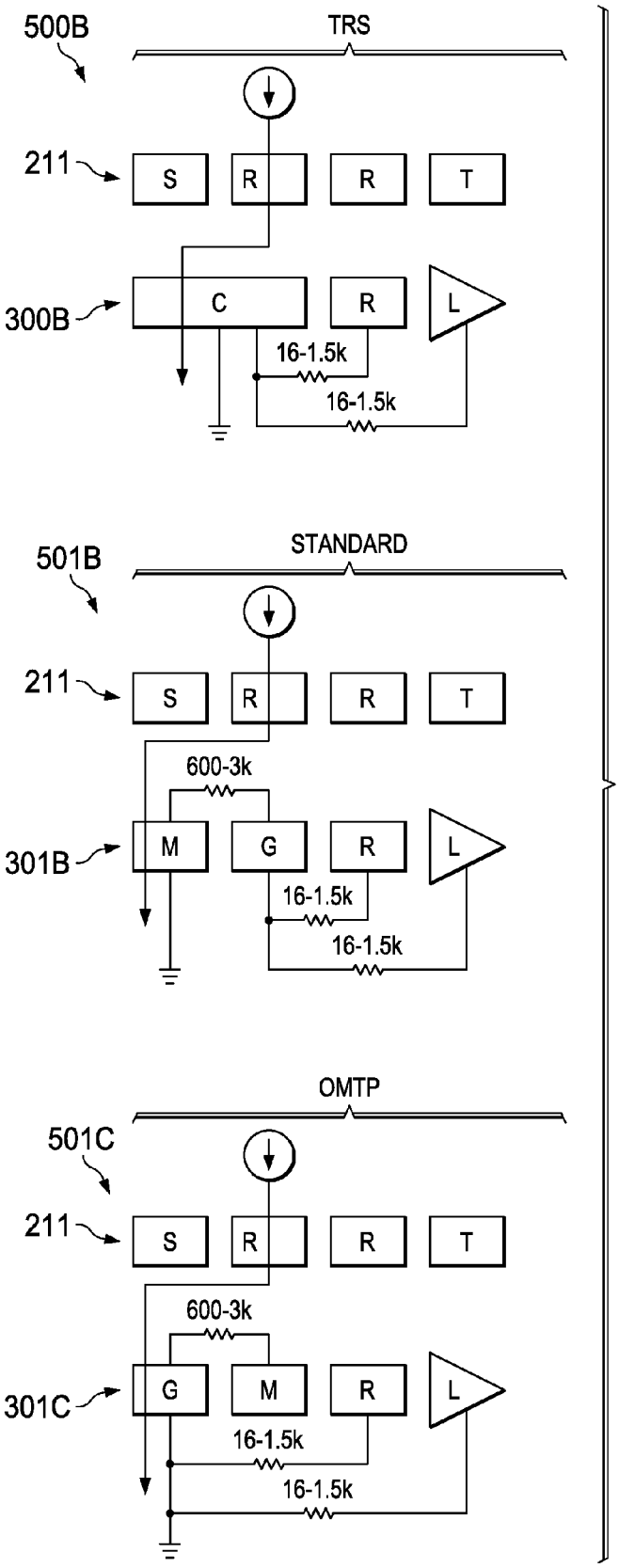

FIG. 5 are diagrams of examples of a first detection stage according to some embodiments.

Figure 6:
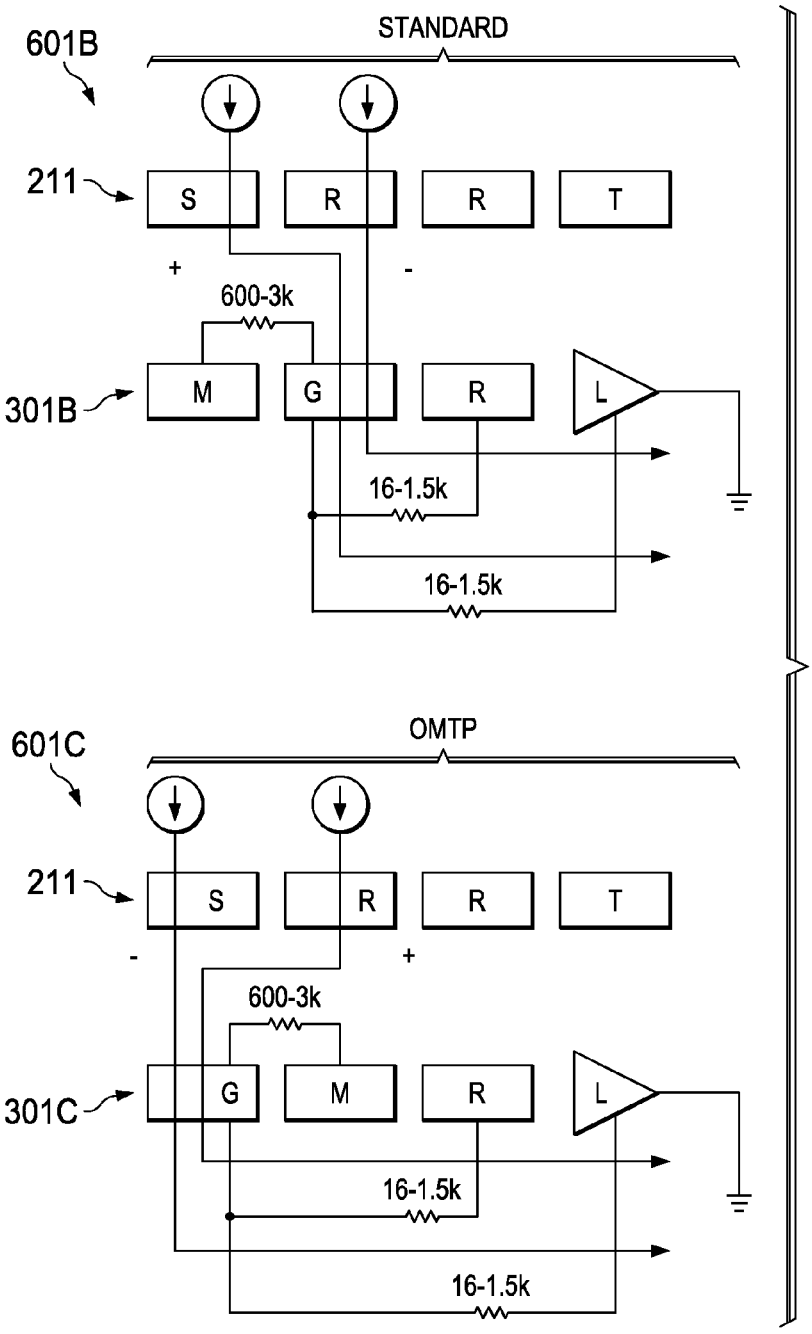

FIG. 6 are diagrams of examples of a second detection stage according to some embodiments.

DETAILED DESCRIPTION

The invention(s) now will be described more fully hereinafter with reference to the accompanying drawings. The invention(s) may, however, be embodied in many different forms and should not be construed as limited to the embodiments set forth herein. Rather, these embodiments are provided so that this disclosure will be thorough and complete, and will fully convey the scope of the invention(s) to a person of ordinary skill in the art. A person of ordinary skill in the art may be able to use the various embodiments of the invention(s).

In many implementations, some of the systems and methods disclosed herein may be incorporated into a wide range of audio-enabled electronic devices including, for example, computer systems, portable audio systems, consumer electronics, automotive systems, and professional audio equipment.

Examples of consumer electronics include television sets, A/V receivers, home theater or sound systems, set-top boxes, docking stations, soundbars, sound projectors, etc. Examples of portable audio systems include tablets, smartphones, media players, camcorders, etc. Examples of automotive audio systems include audio distribution, infotainment, in-seat entertainment, etc. Examples of professional audio systems include recording, live and installation sound, musical instruments, etc. It should be noted, however, that these examples are not limiting, but only demonstrative of the various types of systems which may incorporate the present embodiments, and that additional applications may be possible. More generally, these systems and methods may be incorporated into any device or system having one or more electronic audio parts or components.

Turning to FIG. 1, a diagram of an environment where certain systems and methods described herein may be implemented is depicted. As illustrated, one or more devices or systems such as, for example, automobile 102, loudspeakers 103, A/V receiver 104, and/or audio recording equipment 105 (or any other audio-enabled device or system) may include printed circuit board (PCB) 101 having electronic circuit 100 mounted thereon. In some embodiments, electronic circuit 100 may include one or more analog, digital, and/or mixed signal integrated circuits (ICs) configured to perform loudspeaker protection against excessive excursion, as discussed in more detail below.

In one embodiment, electronic circuit 100 may include an electronic component package configured to be mounted onto PCB 101 using a suitable packaging technology such as Ball Grid Array (BGA) packaging, pin mount packaging, or the like. In some applications, PCB 101 may be mechanically mounted within or fastened onto the electronic device. In other implementations, however, PCB 101 may take a variety of forms and/or may include a plurality of other elements or components in addition to electronic circuit 100. Moreover, in some embodiments, PCB 101 may not be used, and electronic circuit 100 may be integrated with other components of the electronic device without PCB 101.

Examples of IC(s) include a System-On-Chip (SoC), an Application Specific Integrated Circuit (ASIC), a Digital Signal Processor (DSP), a Field-Programmable Gate Array (FPGA), a processor, a microprocessor, a controller, a Microcontroller Unit (MCU), or the like. Additionally, IC(s) may include a memory circuit or device such as a Random Access Memory (RAM) device, a Static RAM (SRAM) device, a Magnetoresistive RAM (MRAM) device, a Non-volatile RAM (NVRAM), and/or a Dynamic RAM (DRAM) device such as Synchronous DRAM (SDRAM), a Double Data Rate (DDR) RAM, an Erasable Programmable Read Only Memory (EPROM), an Electrically Erasable Programmable ROM (EEPROM), etc. IC(s) may also include one or more mixed-signal or analog circuits, such as, for example, Analog-to-Digital Converter (ADCs), Digital-to-Analog Converter (DACs), Phased Locked Loop (PLLs), oscillators, filters, amplifiers, etc.

As such, electronic circuit 100 may include a number of different portions, areas, or regions. These various portions may include one or more processing cores, cache memories, internal bus(es), timing units, controllers, analog sections, mechanical elements, etc.

Although the example of FIG. 1 shows electronic circuit 100 in monolithic form, it should be understood that, in alternative embodiments, various systems and methods described herein may be implemented with discrete components. For example, in some cases, one or more discrete capacitors, inductors, transformers, transistors, registers, logic gates, etc. may be physically located outside of electronic circuit 100 (e.g., elsewhere on PCB 101).

FIG. 2 is a block diagram of an example of audio plug type detection circuit 200 residing within electronic circuit 100 of FIG. 1. As illustrated, detection circuit 200 includes input(s)/output(s) 201, audio input/output jack 202, audio processor 203, and audio codec 204. Components 201, 203, and 204 may be operably coupled to one another via Inter-IC Sound ($I^2S$) bus 205 or other suitable bus. Also, in some devices, detection circuit 200 may be coupled to timing circuit 206, processing cores 207A-N, memory 208, and/or input/output (I/O) interface(s) 210 via bus 209. In some cases, components 206-210 may be a part of another device (e.g., a computer, etc.) that is hosting audio circuit 200.

It should be noted that different bus standards may be used to facilitate communication between different ones of the aforementioned components and/or between detection circuit 200 and components 206-210. Moreover, in some cases, one or more of these components may be directly coupled to each other or embedded within each other (e.g., audio processor 203 may include audio codec 204). As such, it should be understood the particular configurations of audio circuit 200 and other components shown in FIG. 2 are provided for illustration purposes only, and that other configurations are possible.

In operation, audio processor 203 may act either independently or under command of processor core(s) 207A-N to control one or more of components 201-204 (e.g., via $I^2S$ 205) in order to implement certain systems and methods for audio plug type detection. Audio codec 204 may implement one or more algorithms that compress and/or decompress audio data according to a given audio file format or streaming media audio format.

Processor core(s) 207A-N may be any general-purpose or embedded processor(s) implementing any of a variety of Instruction Set Architectures (ISAs), such as the x86, RISC®, PowerPC®, ARM®, etc. In multi-processor systems, each of processor core(s) 210A-N may commonly, but not necessarily, implement the same ISA.

Memory 208 may include for example, a RAM, a SRAM, MRAM, a NVRAM, such as "FLASH" memory, and/or a DRAM, such as SDRAM, a DDR RAM, an EPROM, an EEPROM, etc.

Bus 209 may be used to couple master and slave components together, for example, to share data or perform other data processing operations. In various embodiments, bus 209 may implement any suitable bus architecture, including, for instance, Advanced Microcontroller Bus Architecture® (AMBA®), CoreConnect™ Bus Architecture™ (CCBA™), etc. Additionally or alternatively, bus 209 may be absent and timing circuit 206 or memory 208, for example, may be integrated into processor core(s) 207A-N.

In some embodiments, input(s)/output(s) 201 may include, for example, ADCs, DACs, Phased Locked Loop (PLLs), oscillators, filters, amplifiers, etc. Particularly, input(s)/output(s) 201 may include one or more analog or digital input circuits configured to receive and/or preprocess, analog or digital audio signals (e.g., from a microphone, a line-in connection, an optical source, an S/PDIF line, etc.). In addition, input(s)/output(s) 201 may include one or more analog or digital output circuits configured to provide or output analog or digital audio signals to other devices, such as, for example, a loudspeaker, headphone, a line-out connection, an optical line, an S/PDIF line, etc.).

Audio jack 202 includes a cylindrical opening configured to receive an audio plug of one of a plurality of different types. Along the internal walls of the opening are four contacts 211 at positions corresponding to the tip (T), first Ring (R), second Ring (R), and sleeve (S) terminals of a TRRS audio plug, when one is inserted into the opening. Each of these four contacts 211 is electrically coupled to input(s)/output(s) 201.

In various embodiments, modules or blocks shown in FIG. 2 may represent processing circuitry, logic functions, and/or data structures. Although these modules are shown as distinct blocks, in other embodiments at least some of the operations performed by these modules may be combined in to fewer blocks. Conversely, any given one of the modules of FIG. 2 may be implemented such that its operations are divided among two or more logical blocks. Although shown with a particular configuration, in other embodiments these various modules or blocks may be rearranged according to other suitable embodiments.

FIG. 3 are diagrams of examples of various audio plug types detectable according to some embodiments; and which show: TRS audio plug (3-pole) 300A and corresponding contact diagram 300B, TRRS audio plug (4-pole) 301A, contact diagram 301B for a standard TRRS audio plug, and contact diagram 301C for an Open Mobile Terminal Platform (OMTP) TRRS audio plug.

TRS plug 300A includes a Tip, Ring, and Sleeve contacts or terminals. Diagram 300B shows that TRS plug 300A carries the left audio channel at the Tip (L) and the right audio channel at the Ring (R), while the Sleeve terminal (G) is grounded. Also, a first impedance of approximately 16 to 1.5 kΩ between the Tip (L) and the Sleeve (G) represent a left speaker (e.g., of a headphone), and a second impedance of same value between the Ring (R) and the Sleeve (G) represent a right speaker.

TRRS plug 301A includes a Tip, First Ring, Second Ring, and Sleeve contacts or terminals. Diagram 301B shows that a standard TRRS plug carries the left audio channel at the Tip (L) and the right audio channel at the First Ring (R), the Second Ring (G) is grounded, and the Sleeve terminal (M) carries the microphone channel. A first impedance of approximately 16 to 1.5 kΩ between the First Ring (R) and the Second Ring (G) represents a right speaker and a second impedance of same value between the Tip (L) and the Second Ring (G) represent a left speaker. At third impedance of approximately 600 to 3 kΩ between the Second Ring (G) and the Sleeve (M) represent a microphone.

Still referring to TRRS plug 301A, diagram 301C shows that an OMTP TRRS plug also carries the left audio channel at the Tip (L) and the right audio channel at the First Ring (R), but the Second Ring (M) carries the microphone channel and the Sleeve terminal (G) is grounded. A first impedance of approximately 16 to 1.5 kΩ between the Tip (L) and the Sleeve (G) represents a left speaker and a second impedance of same value between the First Ring (R) and the Sleeve (G) represent a right speaker. At third impedance of approximately 600 to 3 kΩ between the Second Ring (M) and the Sleeve (G) represent a microphone.

FIG. 4 is a flowchart of method 400 for audio plug type detection. In various embodiments, method 400 may be performed in two stages, illustrated in FIGS. 5 and 6, in order to detect, for example, which of plugs 300B, 301B, or 301C is inserted into jack 202 of FIG. 2.

A first stage of detection is performed by blocks 401-405. At block 401, method 400 grounds a sleeve terminal of the audio jack. At block 402, method 400 applies an electrical current to a second ring terminal of the audio jack. At block 403, method 400 measures a voltage between the second ring terminal and the sleeve terminal.

This first stage is illustrated at FIG. 5, where diagram 500B shows contacts 211 positioned relative to a TRS plug configuration with a current flowing from the Second Ring of contacts 211 to the ground terminal of plug 300B. Diagram 501B shows contacts 211 positioned relative to a standard TRRS plug configuration with a current flowing from the Second Ring of contacts 211 to the Microphone terminal (M) of plug 301B through the microphone impedance. And diagram 501C shows contacts 211 positioned relative to an OMTP TRRS plug configuration with a current also flowing from the Second Ring of contacts 211 to the Ground terminal (G) of plug 301C, also through the microphone impedance.

At block 404, method 400 makes an evaluation as to the magnitude of the measured voltage. In response to the magnitude of the voltage being approximately zero, block 405 determines that the audio plug is a 3-pole type. Conversely, in response to a magnitude of the voltage being greater than zero, method 400 determines that the audio plug is a 4-pole type, and moves on to a second stage of detection. In some implementations, the electrical current applied to the second ring of the audio jack may be of the order of 1 μA. The measured voltage may be either zero (in the case of TRS plug configuration 500B) or it may be of the order of 500 mV (in the case of a TRRS plug configuration 501B or 501C).

In sum, the result of the first detection stage is a determination of whether the previously unknown audio plug is a 3-pole TRS plug or a 4-pole TRRS plug.

In a second, subsequent stage, method 400 grounds a tip terminal of the audio plug at block 406. At block 407, method 400 concurrently applies another electrical current to the sleeve terminal and to the second ring terminal of the audio plug. At block 408, method 400 measures a first voltage between the sleeve terminal and the tip terminal. At block 409, method 400 measures a second voltage between the second ring terminal and the tip terminal.

The second stage is illustrated at FIG. 6, diagram 601B shows contacts 211 positioned relative to a standard plug configuration with a first current flowing from the Sleeve of contacts 211 to the ground terminal of plug 301B through the microphone impedance, and a second current flowing from the Second Ring of contacts 211 to the ground terminal of plug 301B. Diagram 601C shows contacts 211 positioned relative to an OMTP plug configuration with a first current flowing from the Sleeve of contacts 211 to the ground terminal of plug 301C, and a second current flowing from the Second Ring of contacts 211 to the ground terminal of plug 301C through the microphone impedance.

At block 410, method 400 makes yet another evaluation. In response to a magnitude of the first voltage being greater than a magnitude of the second voltage, block 411 determines that the audio plug is a standard 4-pole audio plug. Conversely, in response to a magnitude of the first voltage being smaller than a magnitude of the second voltage, block 412 determines that the audio plug is an OMTP 4-pole audio plug.

In some embodiments, the first and second currents are the same—e.g., 1 μA—and difference between the first and second voltages is of the order of approximately 200 mV.

Accordingly, the result of the second detection stage is a determination of whether the 4-pole TRRS plug, assuming one has been detected in the first detection stage, is a standard type or an OMTP type.

* * *

It should be understood that the various operations described herein, particularly in connection with FIGS. 4-6, may be implemented by processing circuitry or other hardware components. The order in which each operation of a given method is performed may be changed, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

A person of ordinary skill in the art will appreciate that the various circuits depicted above are merely illustrative and is not intended to limit the scope of the disclosure described herein. In particular, a device or system configured to perform audio power limiting based on thermal modeling may include any combination of electronic components that can perform the indicated operations. In addition, the operations performed by the illustrated components may, in some embodiments, be performed by fewer components or distributed across additional components. Similarly, in other embodiments, the operations of some of the illustrated components may not be provided and/or other additional operations may be available. Accordingly, systems and methods described herein may be implemented or executed with other circuit configurations.

It will be understood that various operations discussed herein may be executed simultaneously and/or sequentially. It will be further understood that each operation may be performed in any order and may be performed once or repetitiously.

Many modifications and other embodiments of the invention(s) will come to mind to one skilled in the art to which the invention(s) pertain having the benefit of the teachings presented in the foregoing descriptions, and the associated drawings. Therefore, it is to be understood that the invention(s) are not to be limited to the specific embodiments disclosed. Although specific terms are employed herein, they are used in a generic and descriptive sense only and not for purposes of limitation.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A method, comprising:

receiving an audio plug at an audio jack;

grounding a sleeve terminal of the audio jack;

applying a first electrical current to a second ring terminal of the audio jack;

measuring a first voltage between the second ring terminal and the sleeve terminal;

in response to the magnitude of the first voltage being approximately zero, determining that the audio plug is a 3-pole type;

in response to a magnitude of the first voltage being greater than zero, determining that the audio plug is a 4-pole type;

grounding a tip terminal of the audio plug;

applying a second electrical current to the sleeve terminal and to the second ring terminal of the audio plug concurrent with the applying a first electrical current;

measuring a second voltage between the sleeve terminal and the tip terminal;

measuring a third voltage between the second ring terminal and the tip terminal;

in response to a magnitude of the second voltage being greater than a magnitude of the third voltage, determining that the audio plug is a standard 4-pole audio plug; and in response to a magnitude of the second voltage being smaller than a magnitude of the third voltage, determining that the audio plug is an Open Mobile Terminal Platform (OMTP) 4-pole audio plug.

2. The method of claim 1, in which the audio jack is of an unknown type.

3. The method of claim 1, in which the first electrical current is of the order of 1 μA.

4. The method of claim 1, in which the first voltage is of the order of 500 mV.

5. The method of claim 1, in which the second electrical current is of the order of 1 μA.

6. The method of claim 1, in which a difference between the second and third voltage is of the order of 200 mV.

7. An electronic circuit, comprising:

a controller; and a memory coupled to the controller, the memory having program instructions stored thereon that, upon execution by the controller, cause the controller to:

ground a sleeve terminal of an audio jack;

apply a first electrical current to a second ring terminal of the audio jack;

measure a first voltage between the second ring terminal and the sleeve terminal;

in response to the magnitude of the first voltage being approximately zero, determine that the audio plug is a 3-pole type;

in response to a magnitude of the first voltage being greater than zero, determine that the audio plug is a 4-pole type;

ground a tip terminal of the audio plug;

concurrently apply a second electrical current to the sleeve terminal and to the second ring terminal of the audio plug;

measure a second voltage between the sleeve terminal and the tip terminal;

measure a third voltage between the second ring terminal and the tip terminal;

in response to a magnitude of the second voltage being greater than a magnitude of the third voltage, determine that the audio plug is a standard 4-pole audio plug; and in response to a magnitude of the second voltage being smaller than a magnitude of the third voltage, determine that the audio plug is an Open Mobile Terminal Platform (OMTP) 4-pole audio plug.

* * * * *